US008810119B2

(12) United States Patent
Shimizu et al.

(10) Patent No.: US 8,810,119 B2
(45) Date of Patent: Aug. 19, 2014

(54) SPARK PLUG FOR AN INTERNAL COMBUSTION ENGINE

(71) Applicant: Denso Corporation, Kariya (JP)

(72) Inventors: Toshikazu Shimizu, Okazaki (JP); Kouji Yamanaka, Nishio (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 13/944,151

(22) Filed: Jul. 17, 2013

(65) Prior Publication Data

US 2014/0021853 A1 Jan. 23, 2014

(30) Foreign Application Priority Data

Jul. 18, 2012 (JP) ..... 2012-159586

(51) Int. Cl.
*H01T 13/20* (2006.01)

(52) U.S. Cl.
CPC ..... *H01T 13/20* (2013.01)
USPC ..... 313/141; 313/142; 313/138

(58) Field of Classification Search
CPC ..... H01T 13/20; H01T 13/32
USPC ..... 313/141
See application file for complete search history.

(56) References Cited

U.S. PATENT DOCUMENTS 6,495,948 B1 * 12/2002 Garrett, III ..... 313/141
2002/0024160 A1 * 2/2002 Sugimoto ..... 264/12
2007/0216276 A1 9/2007 Takada

FOREIGN PATENT DOCUMENTS

JP 2007-250257 9/2007

* cited by examiner

*Primary Examiner* — Mary Ellen Bowman
(74) *Attorney, Agent, or Firm* — Nixon & Vanderhye PC

(57) ABSTRACT

A spark plug includes a center electrode having an end portion, and an earth electrode having an opposing portion opposed to the end portion via a gap. The end portion has an end-projecting portion. The opposing portion has an opposing-projecting portion opposed to the end-projecting portion. The end-projecting portion and the opposing-projecting portion have non-projection direction opposing surfaces which are parallel to and opposed to each other with a minimum distance and in a direction other than a projection direction. A first opposing area of a portion which includes the non-projection direction opposing surfaces and where the end-projecting portion and the opposing-projecting portion are opposed to each other with the minimum distance is larger than a second opposing area obtained when a plane of the end-projecting portion and a plane of the opposing-projecting portion, which are orthogonal to the projection direction, are opposed to each other in the projection direction.

4 Claims, 14 Drawing Sheets

SPARK PLUG FOR AN INTERNAL COMBUSTION ENGINE

CROSS-REFERENCE TO RELATED APPLICATION

This application is based on and claims the benefit of priority from earlier Japanese Patent Application No. 2012-159586 filed Jul. 18, 2012, the description of which is incorporated herein by reference.

BACKGROUND

1. Technical Field

The present invention relates to a spark plug used for an internal combustion engine of a vehicle or the like.

2. Related Art

Conventionally, a spark plug is known as an ignition means for igniting air fuel mixture introduced into a combustion chamber of the internal combustion engine of a vehicle. For example, such a spark plug has a center electrode and an earth electrode with a spark discharge gap being interposed therebetween.

The lifetime of the spark plug depends on the increase of required voltage due to the extension of the spark discharge gap. That is, repeated spark discharge wears the center electrode and the earth electrode, thereby gradually extending the spark discharge gap therebetween. Accordingly, the required voltage increases which is required as voltage applied between the center electrode and the earth electrode for generating spark discharge. Then, the required voltage exceeds a predetermined value within a range in which some phenomena are not seen such as a decrease in dielectric resistance on a surface of insulator caused by, for example, smoldering. Hence, the spark plug reaches the lifetime thereof.

To solve this problem, various measures are considered for extending the lifetime of the spark plug by devising the structures of the center electrode and the earth electrode forming the spark discharge gap.

For example, JP-A-2007-250257 discloses a spark plug in which a plurality of earth electrodes are opposed to the center electrode to increase an opposing area (discharge area) between the earth electrodes and the center electrode, thereby restraining the extension of the spark discharge gap.

However, according to the measure for the spark plug disclosed in JP-A-2007-250257, in which the number of the earth electrodes opposed to the center electrode is increased, and the opposing area between the center electrode and the earth electrodes are increased, it may be difficult to easily increase the opposing area due to, for example, a constraint of the size of the center electrode or a housing holding the center electrode. Hence, measures are desired which can increase the opposing area between the center electrode and the earth electrodes by a simple structure without being influenced by the constraint of the size or the like.

SUMMARY

An embodiment provides a spark plug for an internal combustion engine which can increase an opposing area between a center electrode and an earth electrode by a simple structure, thereby extending lifetime of the spark plug.

As an aspect of the embodiment, a spark plug for an internal combustion engine is provided. The spark plug includes: a tubular housing; a tubular insulator which is held inside the housing; a center electrode which is held inside the insulator so that an end portion thereof projects; and an earth electrode which has an opposing portion opposed to the end portion of the center electrode, a spark discharge gap being formed between the opposing portion and the end portion. The end portion is provided with an end projecting portion projecting toward the opposing portion. The opposing portion is provided with an opposing projecting portion which projects toward the end portion and is opposed to the end projecting portion. The end projecting portion and the opposing projecting portion are provided with non-projection direction opposing surfaces which are parallel to each other and are opposed to each other with a minimum distance being interposed therebetween and in a direction other than a projection direction thereof. When defining an opposing area of a portion which includes the non-projection direction opposing surfaces and where the end projecting portion and the opposing projecting portion are opposed to each other with the minimum distance being interposed therebetween, as a first opposing area, and defining an opposing area obtained when a plane of the end projecting portion and a plane of the opposing projecting portion, which are orthogonal to the projection direction, are opposed to each other in the projection direction, as a second opposing area, the first opposing area is larger than the second opposing area.

DETAILED DESCRIPTION OF THE PREFERRED EMBODIMENTS

Figure 1:
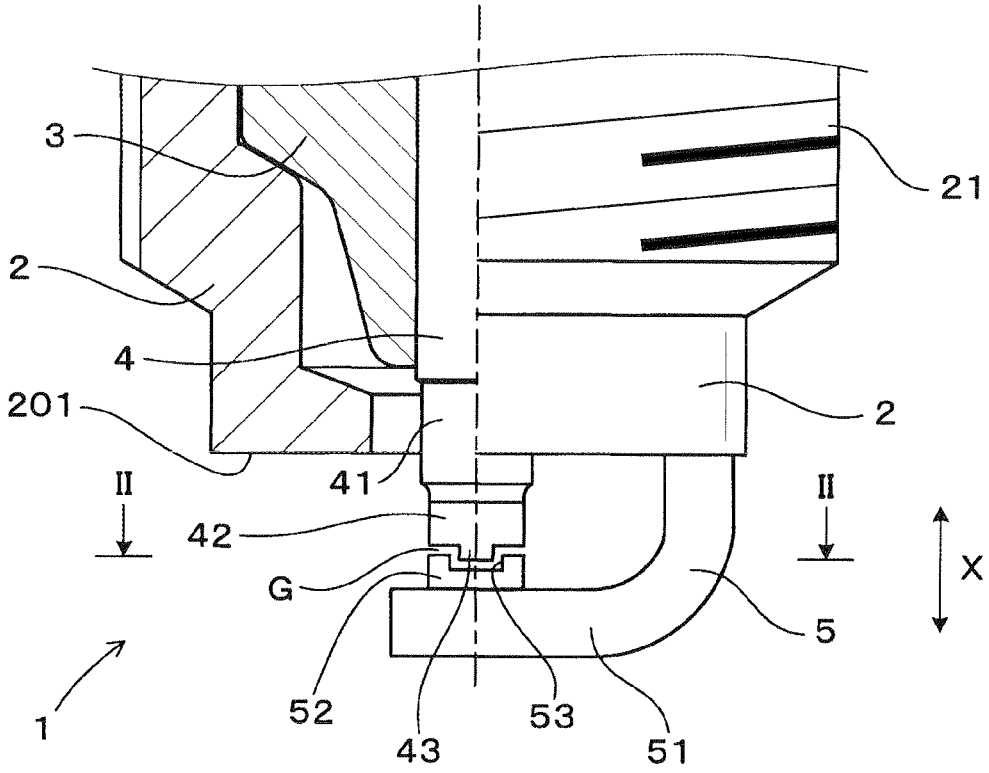
FIG. 1 is a partial sectional view showing a structure of a spark plug according to a first embodiment.

With reference to the accompanying drawings, hereinafter are described embodiments of a spark plug for an internal combustion engine of the present invention.

First Embodiment

As shown in FIGS. 1 to 3B, a spark plug 1 of the present embodiment includes a tubular housing 2, a tubular insulator 3, a center electrode 4, and an earth electrode 5. The insulator 3 is held inside the housing 2. The center electrode 4 is held inside the insulator 3 so that an end portion 41 thereof projects. The earth electrode 5 has an opposing portion 51 opposed to the end portion 41 of the center electrode 4. A spark discharge gap G is formed between the opposing portion 51 and the end portion 41 of the center electrode 4.

The end portion 41 of the center electrode 4 is provided with an end projecting portion 42 projecting toward the opposing portion 51 of the earth electrode 5. The opposing portion 51 of the earth electrode 5 is provided with an opposing projecting portion 52 which projects toward the end portion 41 of the center electrode 4 and is opposed to the end projecting portion 42 of the end portion 41.

As shown in FIGS. 1 to 3B, the end projecting portion 42 of the center electrode 4 and the opposing projecting portion 52 of the earth electrode 5 are provided with non-projection direction opposing surfaces 492, 592 which are parallel to each other and are opposed to each other with a minimum distance D being interposed therebetween and in the direction other than the projection direction X thereof.

When defining an opposing area of a portion which includes the non-projection direction opposing surfaces 492, 592 and where the end projecting portion 42 and the opposing projecting portion 52 are opposed to each other with the minimum distance D being interposed therebetween, as A (first opposing area), and defining an opposing area obtained when a plane 490 of the end projecting portion 42 and a plane 590 of the opposing projecting portion 52 (see FIGS. 19 and 20), which are orthogonal to the projection direction X, are opposed to each other in the projection direction X, as B (second opposing area), the opposing area A is larger than the opposing area B.

The details are described below.

As shown FIG. 1, in the spark plug 1, a mounting screw portion 21 is provided on the outer periphery of the tubular housing 2. The spark plug 1 is attached by screwing the mounting screw portion 21 into a screw hole (not shown) formed in a wall portion of a combustion chamber of an engine.

In addition, the tubular insulator 3 is inserted and held inside the housing 2. The center electrode 4 is held inside the insulator 3. The center electrode 4 is held in a state where the end portion 41 thereof projects toward the end side with respect to the insulator 3. In addition, the end portion 41 of the center electrode 4 is provided with the end projecting portion 42 which projects toward the opposing portion 51 of the earth electrode 5 described later.

In addition, the earth electrode 5 is joined to an end surface 201 of the housing 2. The earth electrode 5 extends from the end surface 201 and along the center electrode 4, and is bent to the inside, thereby forming the opposing portion 51 which is opposed to the end portion 41 of the center electrode 4. The opposing portion 51 of the earth electrode 5 is provided with an opposing projecting portion 52 which projects toward the end portion 41 of the center electrode 4 and is opposed to the end projecting portion 42 of the end portion 41.

In addition, the spark discharge gap G is provided between the end projecting portion 42 of the center electrode 4 and the opposing projecting portion 52 of the earth electrode 5. That is, by providing a predetermined distance between the end projecting portion 42 and the opposing projecting portion 52, the spark discharge gap G is provided.

In addition, the end projecting portion 42 and the opposing projecting portion 52 are formed of noble metal chips such as iridium alloy and are formed into substantially cylindrical shapes having the same diameter. The outside diameters of the end projecting portion 42 and the opposing projecting portion 52 can be set within a range of 2 to 5 mm.

Figure 2:
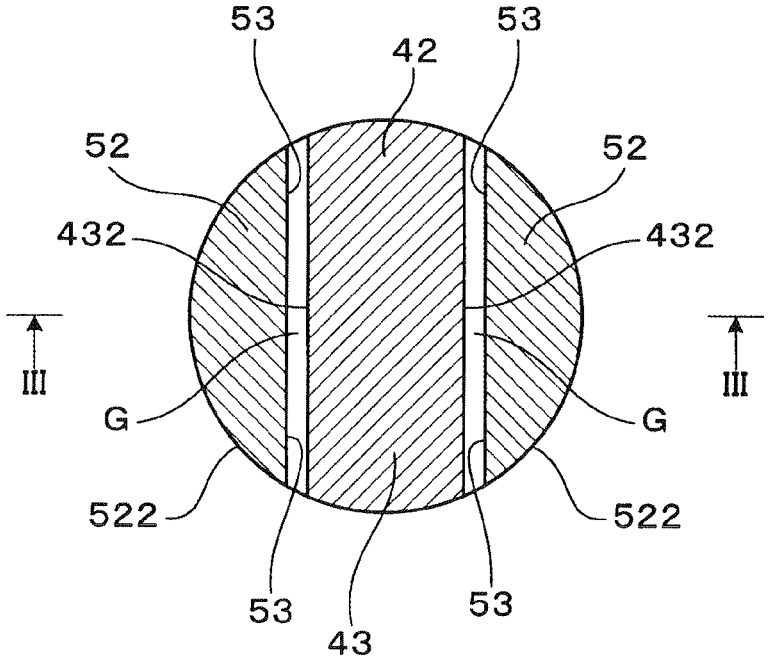
FIG. 2 is a sectional view taken in the direction of arrows II of FIG. 1.
Figure 3A:
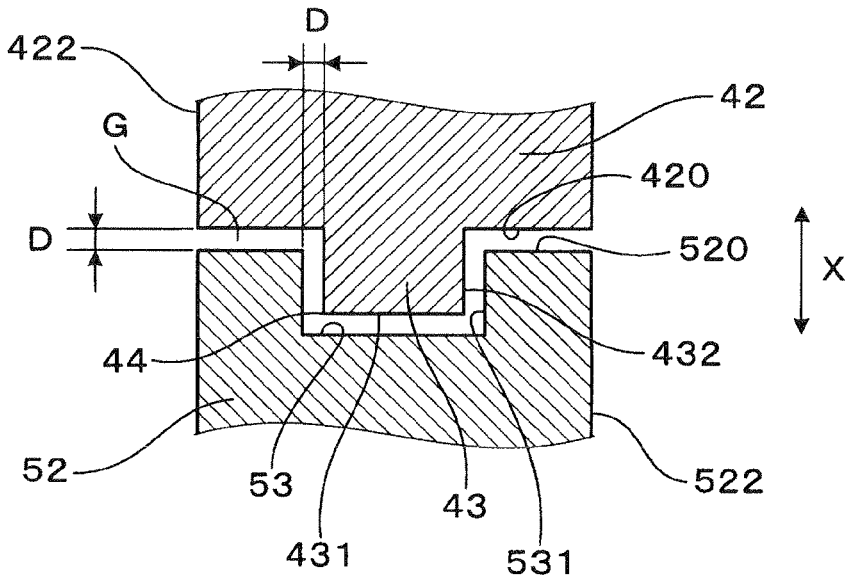
FIG. 3A is a sectional view taken in the direction of arrows III of FIG. 2 and showing shapes of an end projecting portion of a center electrode and an opposing projecting portion of an earth electrode.

As shown in FIGS. 2 and 3A, the end projecting portion 42 of the center electrode 4 is provided with a convex projection portion 43 which projects from a reference surface 420 of the end projecting portion 42 toward the opposing projecting portion 52, that is, to the end side. Note that the reference surface 420 is a plane orthogonal to the projection direction X.

In addition, the projection portion 43 is formed in the radial direction so as to connect between circumference surfaces 422 of the end projecting portion 42 of the center electrode 4. The cross section of the projection portion 43 orthogonal to the radial direction has a rectangular shape. The projection portion 43 is provided with corner portions 44 formed with an end surface 431 and side surfaces 432. The width of the convex projection portion 43 can be set, for example, within a range of 0.8 to 1 mm, where the outer diameters of the end projecting portion 42 and the opposing projecting portion 52 are 2.4 mm.

Meanwhile, the opposing projecting portion 52 of the earth electrode 5 is provided with a concave portion 53 which has a concave groove shape recessed from a reference surface 520 of the opposing projecting portion 52 to the end side. Note that the reference surface 520 is a plane orthogonal to the projection direction X and parallel to the reference surface 420 of the end projecting portion 42 of the center electrode 4.

In addition, the concave portion 53 is formed in the radial direction so as to connect between circumference surfaces 522 of the opposing projecting portion 52 of the earth electrode 5. In the concave portion 53, part of the projection portion 43 of the end projecting portion 42 of the center electrode 4 is disposed. The shape of the concave portion 53 corresponds to the shape (rectangular shape) of the convex projection portion 43.

Figure 3B:
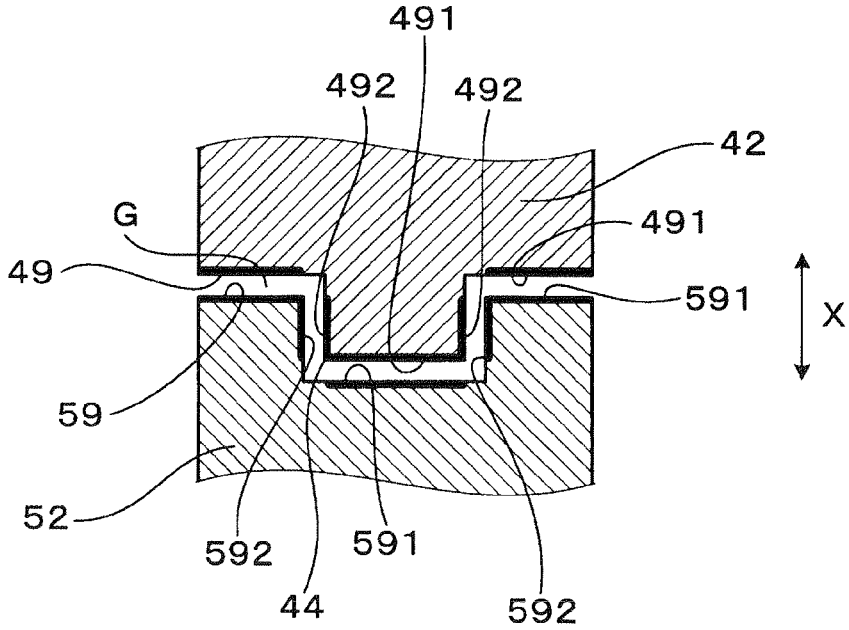
FIG. 3B is a sectional view taken in the direction of arrows III of FIG. 2 and showing an opposing surface.

As shown in FIG. 3B, the end projecting portion 42 of the center electrode 4 and the opposing projecting portion 52 of the earth electrode 5 have opposing surfaces 49, 59 (portions indicated by thick lines in FIG. 3B) which are opposed to each other with a minimum distance D (see FIG. 3A) being interposed therebetween. In the present embodiment, the opposing surface 49 of the end projecting portion 42 of the center electrode 4 is part of the reference surface 420 of the end projecting portion 42, and part of the end surface 431 of the convex projection portion 43 and the side surfaces 432 of the convex projection portion 43. The opposing surface 59 of the opposing projecting portion 52 of the earth electrode 5 is part of the reference surface 520 of the opposing projecting portion 52 and an inner wall surface 531 of the concave portion 53. The minimum distance D can be set, for example, within a range of 0.2 to 0.5 mm.

In addition, the opposing surface 49 of the end projecting portion 42 of the center electrode 4 and the opposing surface 59 of the opposing projecting portion 52 of the earth electrode 5 have projection direction opposing surfaces 491, 591 and the non-projection direction opposing surfaces 492, 592. The projection direction opposing surfaces 491, 591 are parallel to each other and are opposed to each other with the minimum distance D being interposed therebetween in the projection direction X thereof. The non-projection direction opposing surfaces 492, 592 are parallel to each other and are opposed to each other with the minimum distance D being interposed therebetween in the direction other than the projection direction X thereof.

In addition, the corner portions 44 of the convex projection portion 43 of the end projecting portion 42 of the center electrode 4 are opposed to the inner wall surface 531 of the concave portion 53 of the opposing projecting portion 52 of the earth electrode 5 with the minimum distance D being interposed therebetween.

In addition, the opposing area A between the end projecting portion 42 of the center electrode 4 and the opposing projecting portion 52 of the earth electrode 5 is larger than the opposing area B. The opposing area A is 1.25 times or more larger than the opposing area B and 1.75 times or less larger than the opposing area B. In the present embodiment, the opposing area A is 1.5 times larger than the opposing area B.

The opposing area A is a portion which includes the non-projection direction opposing surfaces 492, 592 and where the end projecting portion 42 and the opposing projecting portion 52 are opposed to each other with the minimum distance D being interposed therebetween, that is, an opposing area of the projection direction opposing surfaces 491, 591 and the non-projection direction opposing surfaces 492, 592.

Figure 19:
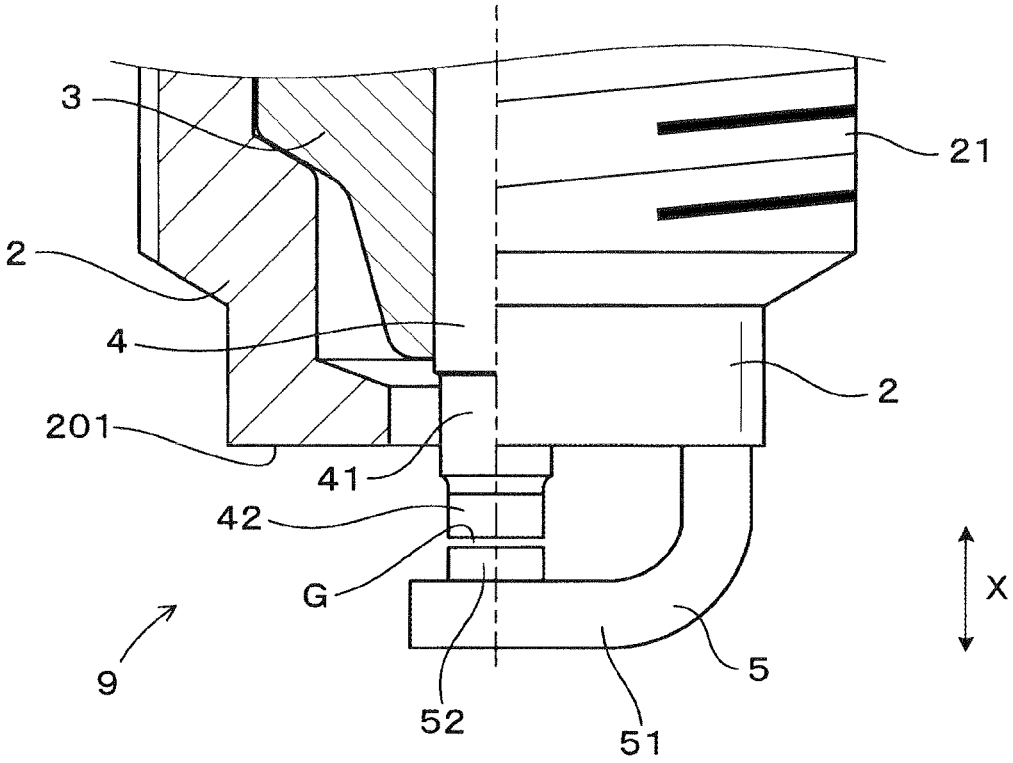
FIG. 19 is a partial sectional view showing a structure of a spark plug according to the first to sixth embodiments.
Figure 20:
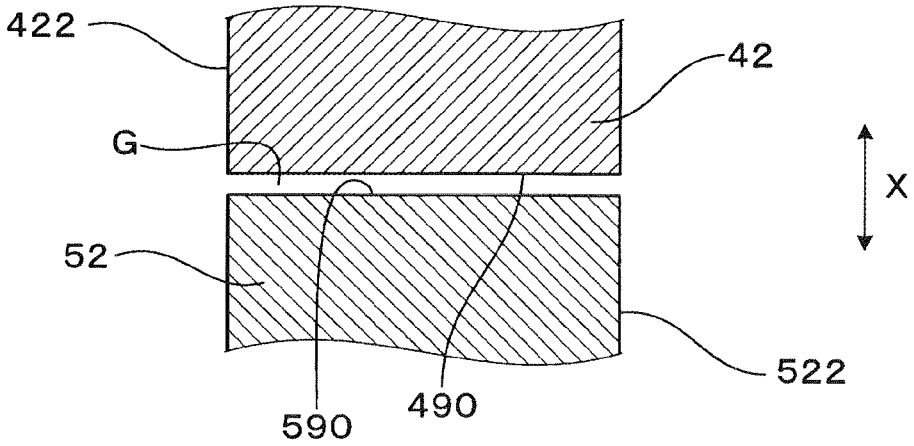
FIG. 20 is a sectional view showing shapes of the end projecting portion of the center electrode and the opposing projecting portion of the earth electrode according to the first to sixth embodiments.

As shown in FIGS. 19 and 20, the opposing area B is an opposing area obtained when the plane 490 of the end projecting portion 42 of the center electrode 4 and the plane 590 of the opposing projecting portion 52, which are orthogonal to the projection direction X, are opposed to each other in the projection direction X without changing outer shapes of the end projecting portion 42 and the opposing projecting portion 52 in a spark plug 9.

Next, a manufacturing method for the end projecting portion 42 of the center electrode 4 and the opposing projecting portion 52 of the earth electrode 5 is described with reference to FIG. 1.

As one example, a noble metal member having a substantially cylindrical shape and formed of, for example, iridium alloy is disposed between the end portion 41 of the center electrode 4 and the opposing portion 51 of the earth electrode 5. One end of the noble metal member is welded to the end portion 41 of the center electrode 4. The other end of the noble metal member is welded to the opposing portion 51 of the earth electrode 5. Next, the noble metal member is cut by a cutting process such as a wire cut process. In this process, a portion corresponding to the spark discharge gap G is cut off.

Accordingly, as shown in FIG. 1, the end projecting portion 42 of the center electrode 4 and the opposing projecting portion 52 of the earth electrode 5 are formed. In addition, the spark discharge gap G is formed between the end projecting portion 42 and the opposing projecting portion 52.

In addition, as an another example, two noble metal members having substantially cylindrical shapes and formed of, for example, iridium alloy are individually welded to the end portion 41 of the center electrode 4 and the opposing portion 51 of the earth electrode 5. The noble metal members individually serve as the end projecting portion 42 of the center electrode 4 and the opposing projecting portion 52 of the earth electrode 5. At this time, a predetermined clearance is provided between the end projecting portion 42 and the opposing projecting portion 52.

Accordingly, as shown in FIG. 1, the end projecting portion 42 and the opposing projecting portion 52 are formed. In addition, the spark discharge gap G is formed between the end projecting portion 42 and the opposing projecting portion 52.

Note that the end projecting portion 42 of the center electrode 4 and the opposing projecting portion 52 of the earth electrode 5 can be manufactured by using another method.

Next, advantages of the spark plug 1 of the present embodiment are described.

In the spark plug 1, the end projecting portion 42 of the center electrode 4 and the opposing projecting portion 52 of the earth electrode 5 are provided with the non-projection direction opposing surfaces 492, 592 which are parallel to each other and are opposed to each other with the minimum distance D being interposed therebetween in the direction other than the projection direction X. In addition, the opposing area A of a portion which includes the non-projection direction opposing surfaces 492, 592 and where the end projecting portion 42 and the opposing projecting portion 52 are opposed to each other with the minimum distance D being interposed therebetween is larger than the opposing area B obtained when the plane 490 and the plane 590, which are orthogonal to the projection direction X, are opposed to each other in the projection direction X.

Hence, by a simple structure, in which the non-projection direction opposing surfaces 492, 592 are provided on the end projecting portion 42 and the opposing projecting portion 52, an opposing area (discharge area) between the center electrode 4 and the earth electrode 5 can be easily increased. As a result, the extension of the spark discharge gap G due to wear of the end projecting portion 42 and the opposing projecting portion 52 caused by the spark discharge can be restricted, which can extend the lifetime of the spark plug 1.

In addition, an opposing area between the center electrode and the earth electrodes can be increased by a simple structure. Hence, shapes of the end projecting portion of the center electrode and the opposing projecting portion of the earth electrode can be prevented from being complicated. In addition, the size (outside diameter or the like) of the end projecting portion of the center electrode and the opposing projecting portion of the earth electrode can be prevented from increasing.

In addition, in the present embodiment, one (end projecting portion 42) of the end projecting portion 42 and the opposing projecting portion 52 is provided with the projection portion 43 projecting toward the other (opposing projecting portion 52) of the end projecting portion 42 and the opposing projecting portion 52. The projection portion 43 is provided with the corner portions 44 opposed to the other (opposing projecting portion 52) with the minimum distance D being interposed therebetween. Hence, spark discharge easily occur from the corner portions 44 of the projection portion 43 provided on the end projecting portion 42 of the center electrode 4 toward the opposing projecting portion 52 of the earth electrode 5, which can decrease the required voltage which is required for the spark discharge. Hence, wear of the electrode due to the spark discharge can be restrained, which can further extend the lifetime of the spark plug.

In addition, the opposing area A is 1.25 times or more larger than the opposing area B. Hence, the above advantage to extend the lifetime of the spark plug can be effectively utilized by increasing the opposing area between the center electrode 4 and the earth electrode 5 with a simple structure.

In addition, the opposing area A is 1.75 times or less larger than the opposing area B. Hence, shapes of the end projecting portion 42 of the center electrode 4 and the opposing projecting portion 52 of the earth electrode 5 can be prevented from being complicated. In addition, the size (outside diameter or the like) of the end projecting portion 42 and the opposing projecting portion 52 can be prevented from increasing.

As described above, according to the present embodiment, the spark plug 1 used for an internal combustion engine is provided which can extend the lifetime thereof by increasing the opposing area between the center electrode 4 and the earth electrode 5 with a simple structure.

Second Embodiment

In the present embodiment, as shown in FIGS. 4 to 9, shapes of the end projecting portion 42 of the center electrode 4 and the opposing projecting portion 52 of the earth electrode 5 are changed.

Figure 4A:
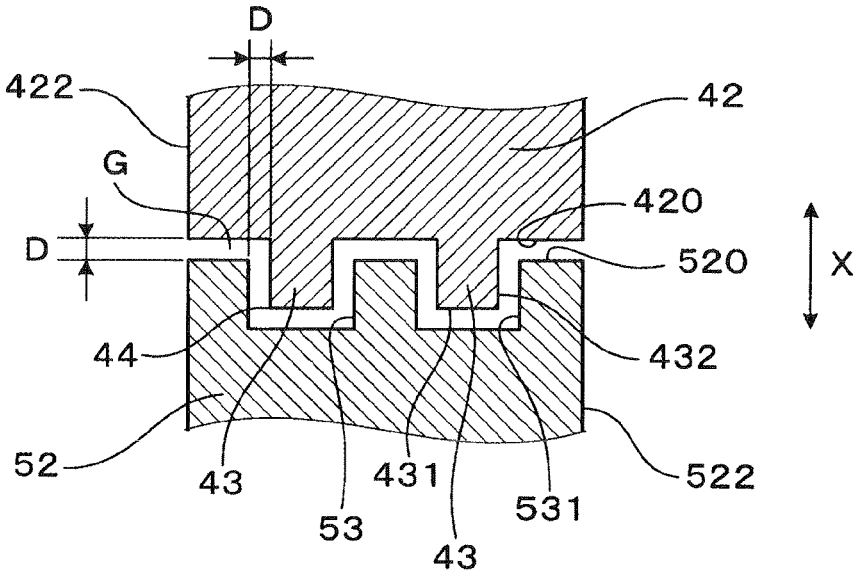
FIG. 4A is a sectional view showing shapes of an end projecting portion of a center electrode and an opposing projecting portion of an earth electrode according to a second embodiment.
Figure 4B:
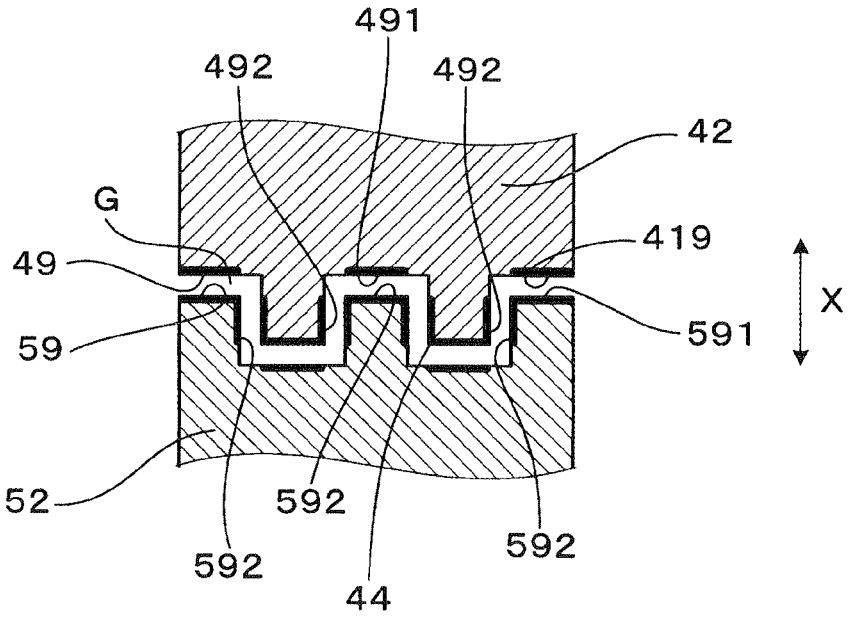
FIG. 4B is a sectional view showing an opposing surface according to the second embodiment.

In the example shown in FIGS. 4A and 4B, the end projecting portion 42 of the center electrode 4 is provided with two convex projection portions 43. In addition, the opposing projecting portion 52 of the earth electrode 5 is provided with two concave portions 53 having concave groove shapes.

Figure 5A:
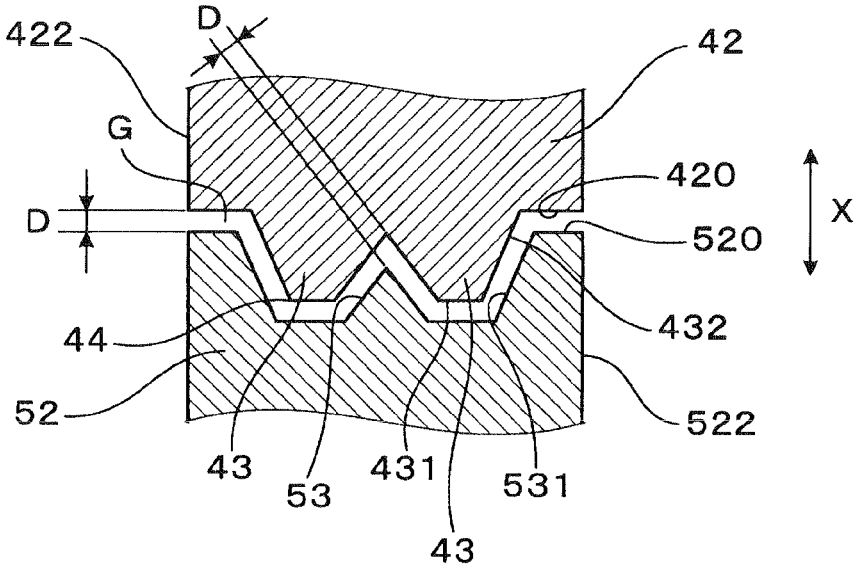
FIG. 5A is a sectional view showing shapes of an end projecting portion of a center electrode and an opposing projecting portion of an earth electrode according to the second embodiment.
Figure 5B:
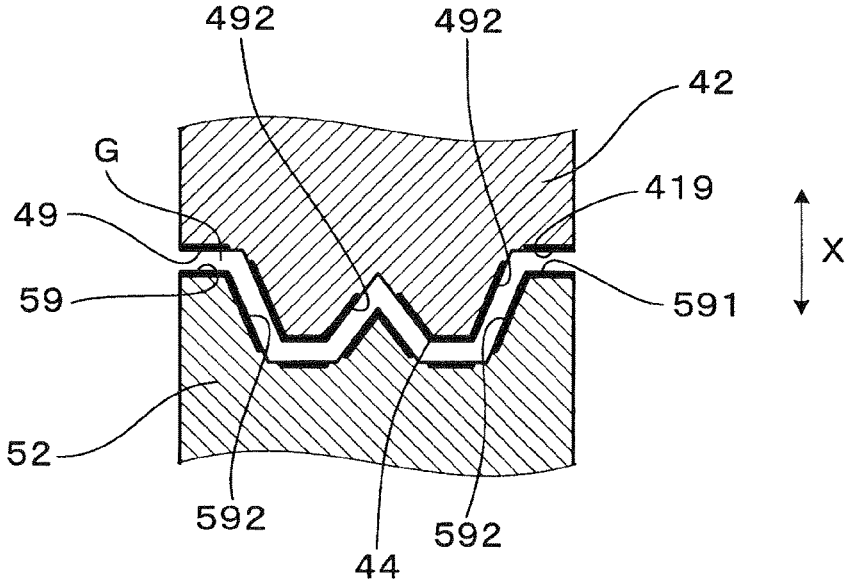
FIG. 5B is a sectional view showing an opposing surface according to the second embodiment.

In the example shown in FIGS. 5A and 5B, the end projecting portion 42 of the center electrode 4 is provided with two convex projection portions 43. Cross sections of the projection portions 43 orthogonal to the radial direction are trapezoid shapes. In addition, the opposing projecting portion 52 of the earth electrode 5 is provided with two concave portions 53 having concave groove shapes corresponding to the shapes (trapezoid shapes) of the projection to portions 43 of the end projecting portion 42 of the center electrode 4.

Figure 6A:
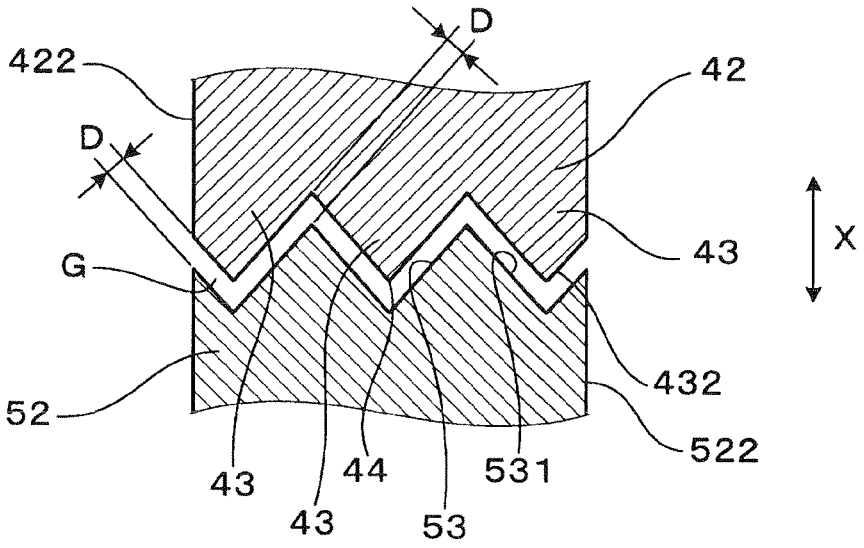
FIG. 6A is a sectional view showing shapes of an end projecting portion of a center electrode and an opposing projecting portion of an earth electrode according to the second embodiment.
Figure 6B:
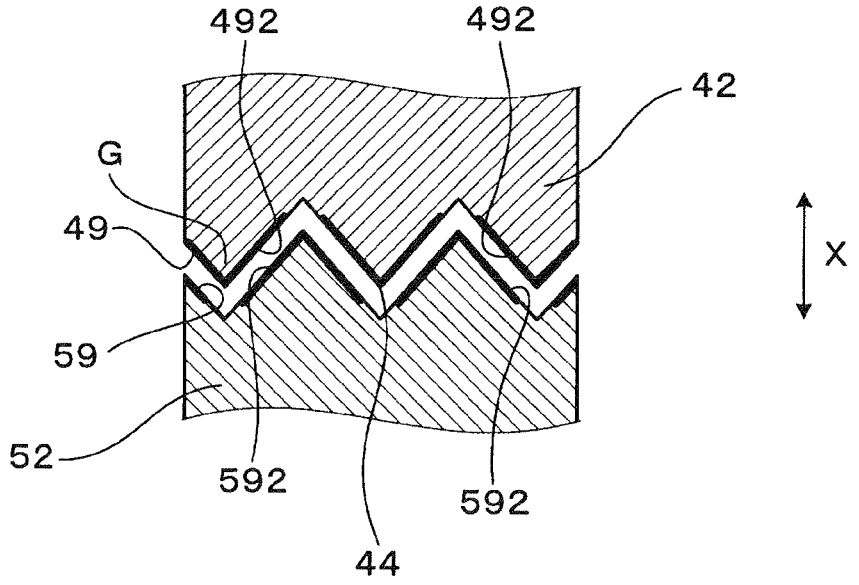
FIG. 6B is a sectional view showing an opposing surface according to the second embodiment.

In the example shown in FIGS. 6A and 6B, the end projecting portion 42 of the center electrode 4 is provided with three convex projection portions 43. Cross sections of the projection portions 43 orthogonal to the radial direction are triangle shapes. In addition, the opposing projecting portion 52 of the earth electrode 5 is provided with three concave portions 53 having concave groove shapes (triangle shapes) corresponding to the shapes of the projection portions 43 of the end projecting portion 42 of the center electrode 4.

Note that, in the example shown in FIG. 6, the end projecting portion 42 and the opposing projecting portion 52 are provided with the reference surfaces 420, 520 (see FIGS. 4 and 5).

Figure 7A:
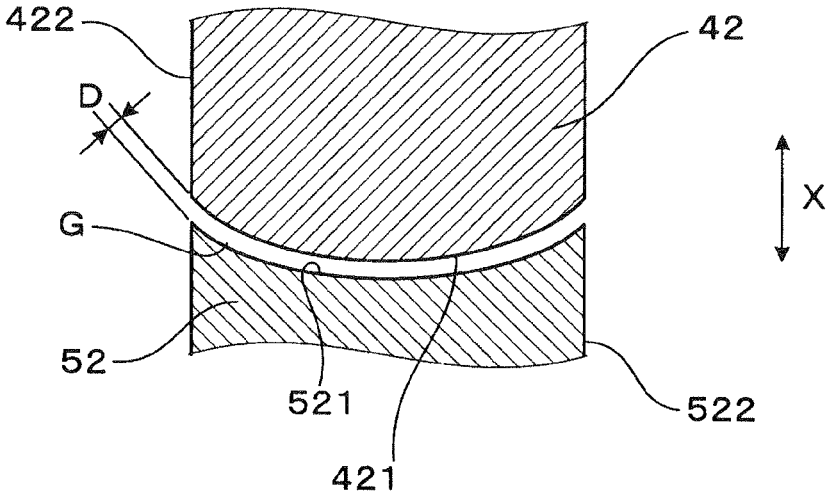
FIG. 7A is a sectional view showing shapes of an end projecting portion of a center electrode and an opposing projecting portion of an earth electrode according to the second embodiment.
Figure 7B:
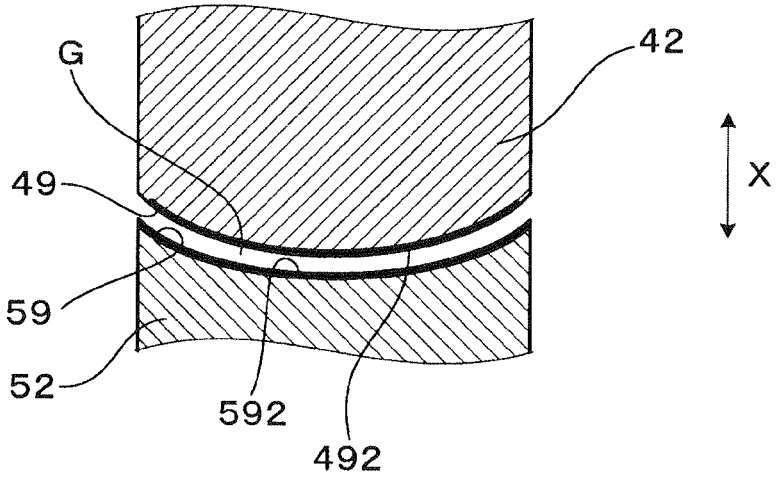
FIG. 7B is a sectional view showing an opposing surface according to the second embodiment.

In the example shown in FIGS. 7A and 7B, an end surface 421 of the end projecting portion 42 of the center electrode 4 has a convex shape. In addition, an end surface 521 of the opposing projecting portion 52 of the earth electrode 5 has a concave shape corresponding to the end surface 421 of the end projecting portion 42 of the center electrode 4.

Figure 8A:
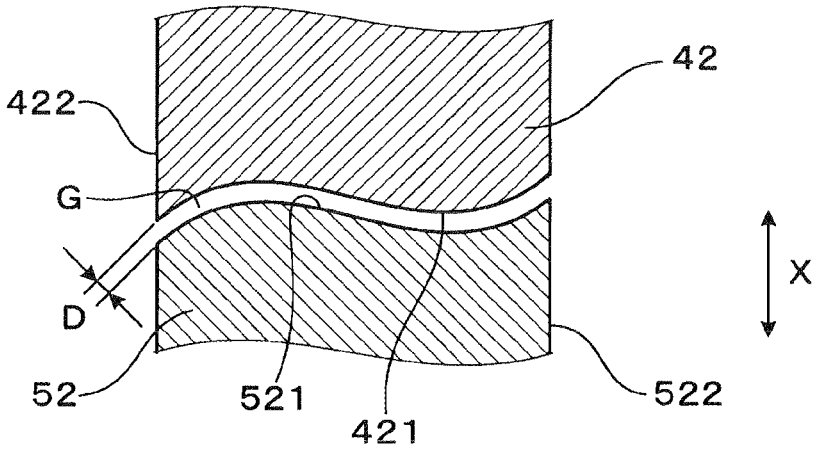
FIG. 8A is a sectional view showing shapes of an end projecting portion of a center electrode and an opposing projecting portion of an earth electrode according to the second embodiment.
Figure 8B:
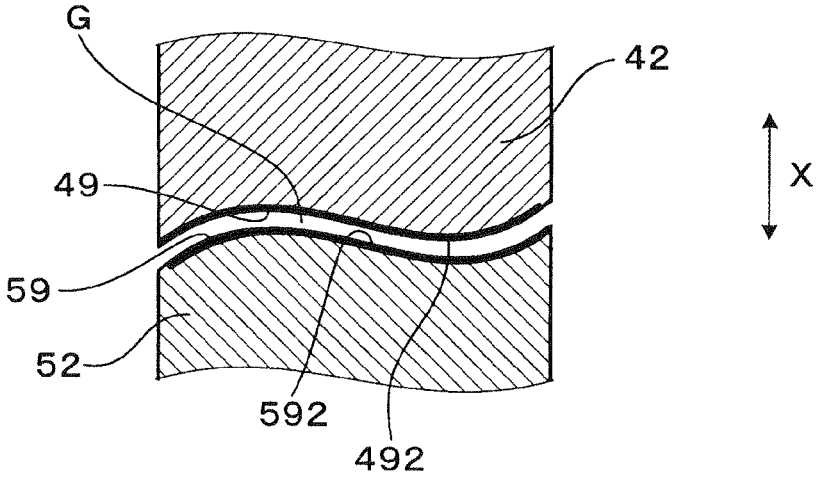
FIG. 8B is a sectional view showing an opposing surface according to the second embodiment.

In the example shown in FIGS. 8A and 8B, the end surface 421 of the end projecting portion 42 of the center electrode 4 has a waved shape having convexes and concaves. In addition, the end surface 521 of the opposing projecting portion 52 of the earth electrode 5 has a waved shape having concaves and convexes so as to correspond to the end surface 421.

Figure 9A:
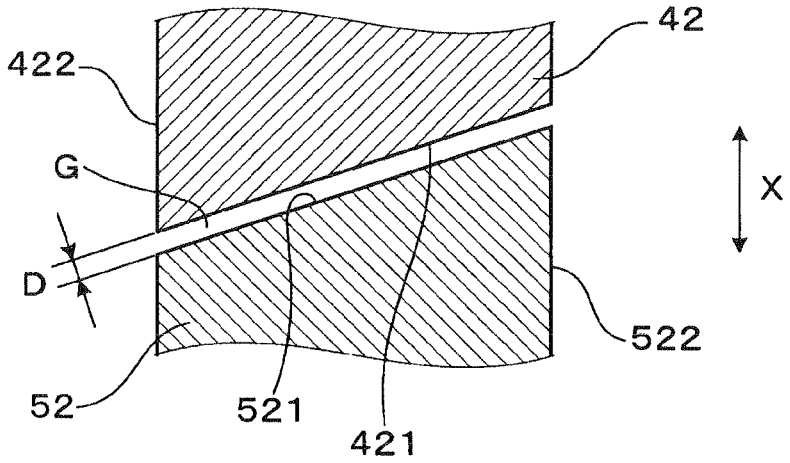
FIG. 9A is a sectional view showing shapes of an end projecting portion of a center electrode and an opposing projecting portion of an earth electrode according to the second embodiment.
Figure 9B:
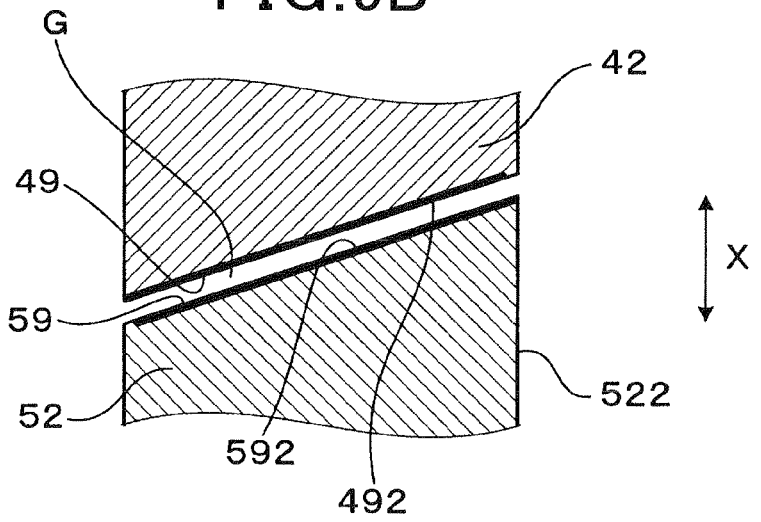
FIG. 9B is the sectional view showing an opposing surface according to a second embodiment.

In the example shown in FIGS. 9A and 9B, the end surface 421 of the end projecting portion 42 of the center electrode 4 and the end surface 521 of the opposing projecting portion 52 of the earth electrode 5 are planes which incline with respect to the projection direction X at a predetermined angle and are parallel to each other.

Note that, in the examples shown in FIGS. 7A to 9B, the end projecting portion 42 of the center electrode 4 is not provided with the projection portions 43 (see FIGS. 4A to 6B and the like) and the corner portions 44 (see FIGS. 4A to 6B and the like). In addition, the opposing projecting portion 52 of the earth electrode 5 is not provided with the concave portion 53 (see FIGS. 4A to 6B and the like).

Other basic configurations and advantages of the examples described above are the same as those of the first embodiment.

Third Embodiment

In the present embodiment, as shown in FIGS. 10 to 13, a plurality of earth electrode 5 are provided with respect to the center electrode 4.

Figure 10:
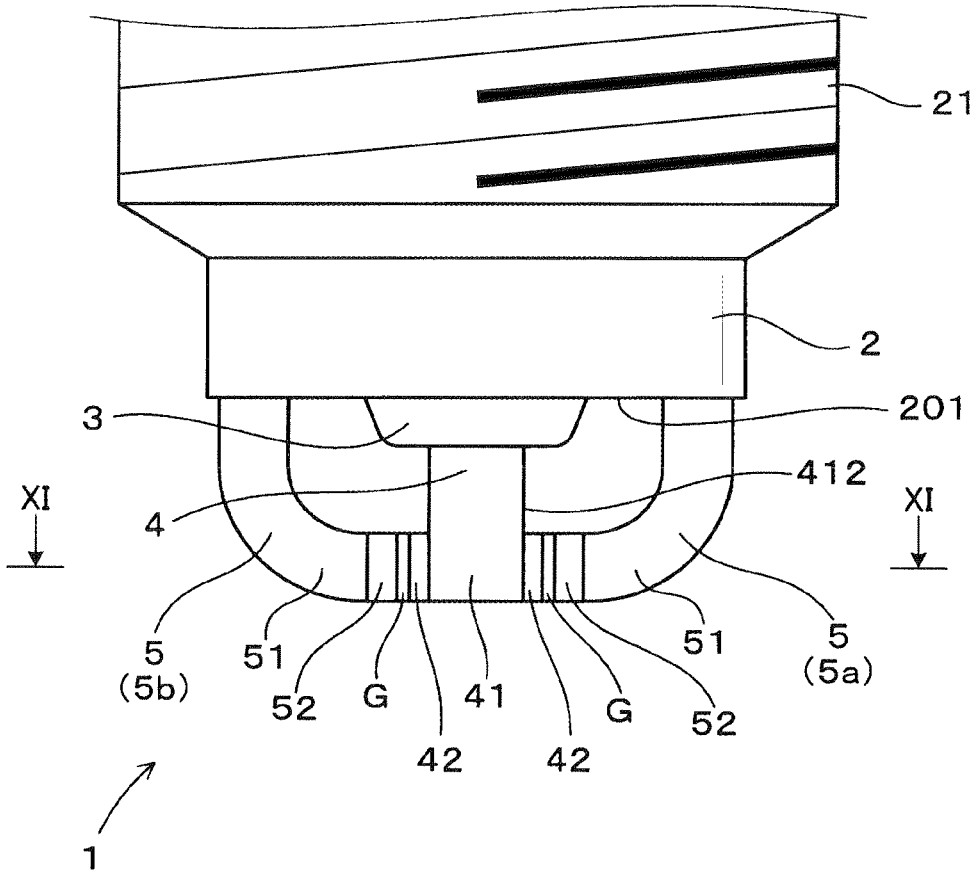
FIG. 10 is a front view showing a structure of a spark plug according to a third embodiment.
Figure 11:
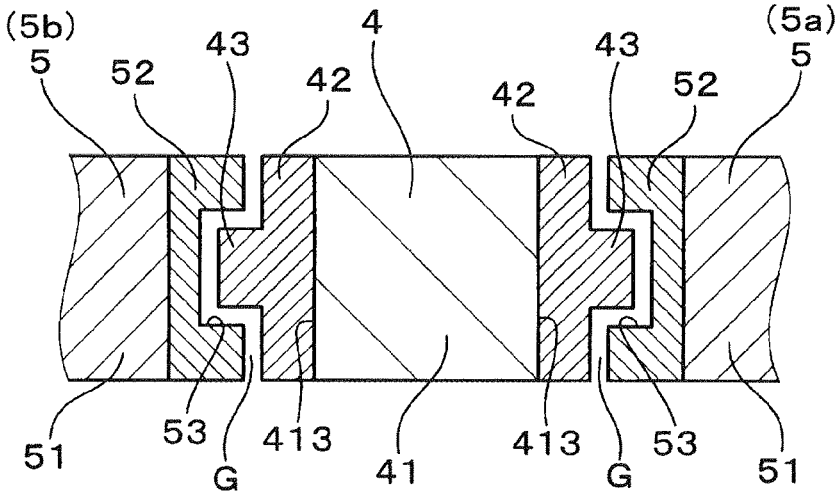
FIG. 11 is a sectional view taken in the direction of arrows XI of FIG. 10.

In the example shown in FIGS. 10 and 11, two earth electrodes 5 (5*a*, 5*b*) are provided with respect to the center electrode 4.

As shown in FIGS. 10 and 11, the two earth electrodes 5*a*, 5*b* are connected to the end surface 201 of the housing 2. The opposing portions 51 of the two earth electrode 5*a*, 5*b* are provided so as to extend toward the end portion 41 of the center electrode 4 from two directions and in the direction orthogonal to the axis direction of the spark plug 1.

As shown in FIGS. 10 and 11, the square pole-shaped end portion 41 of the center electrode 4 is provided with four side surfaces 413. Two of the side surfaces 413 are provided with two end projecting portions 42 projecting toward the opposing portions 51 of the earth electrode 5*a*, 5*b*.

In addition, the opposing portions 51 of the earth electrodes 5*a*, 5*b* are provided with two opposing projecting portions 52 which project toward the end portion 41 of the center electrode 4 and are opposed to the end projecting portions 42 of the end portion 41.

Figure 12:
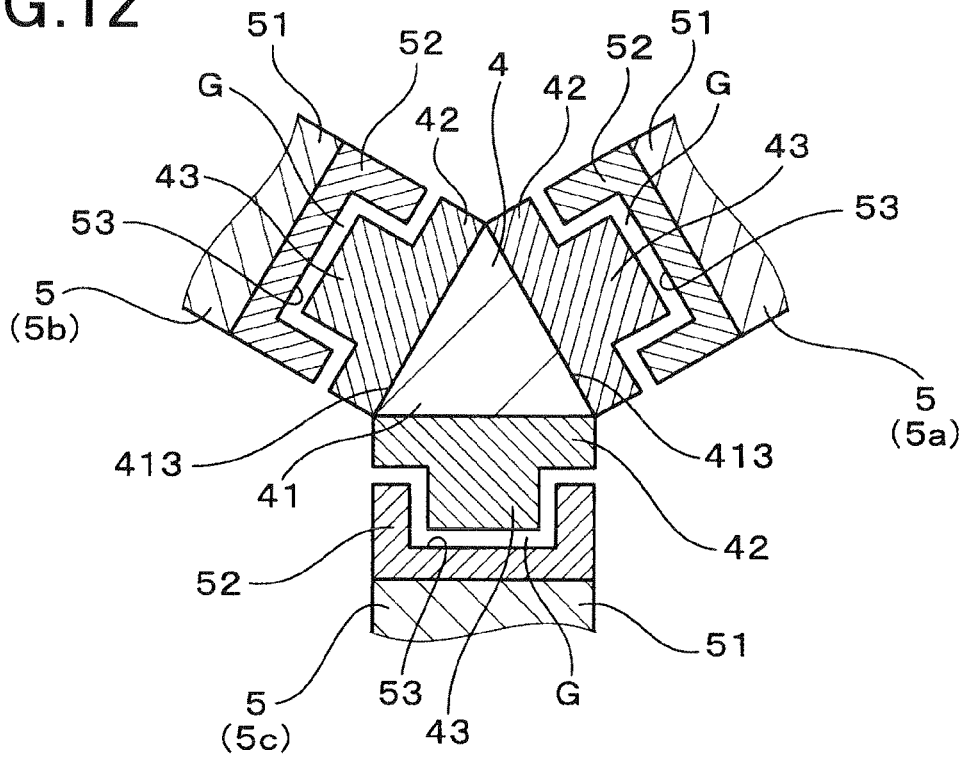
FIG. 12 is a sectional view showing structures of a center electrode and an earth electrode according to the third embodiment.

In the example shown in FIG. 12, three earth electrodes 5 (5*a* to 5*c*) are provided with respect to the center electrode 4.

As shown in FIG. 12, three earth electrodes 5*a* to 5*c* are connected to the end surface 201 (FIG. 10) of the housing 2 (FIG. 10). The opposing portions 51 of the three earth electrodes 5*a* to 5*c* are provided so as to extend toward the end portion 41 of the center electrode 4 from three directions and in the direction orthogonal to the axis direction of the spark plug 1 (FIG. 10).

As shown in FIG. 12, the triangle pole-shaped end portion 41 of the center electrode 4 is provided with three side surfaces 413. The three side surfaces 413 are provided with three end projecting portions 42 projecting toward the opposing portions 51 of the earth electrodes 5*a* to 5*c*.

In addition, the opposing portions 51 of the earth electrodes 5*a* to 5*c* are provided with three opposing projecting portions 52 which project toward the end portion 41 of the center electrode 4 and are opposed to the end projecting portions 42 of the end portion 41.

Figure 13:
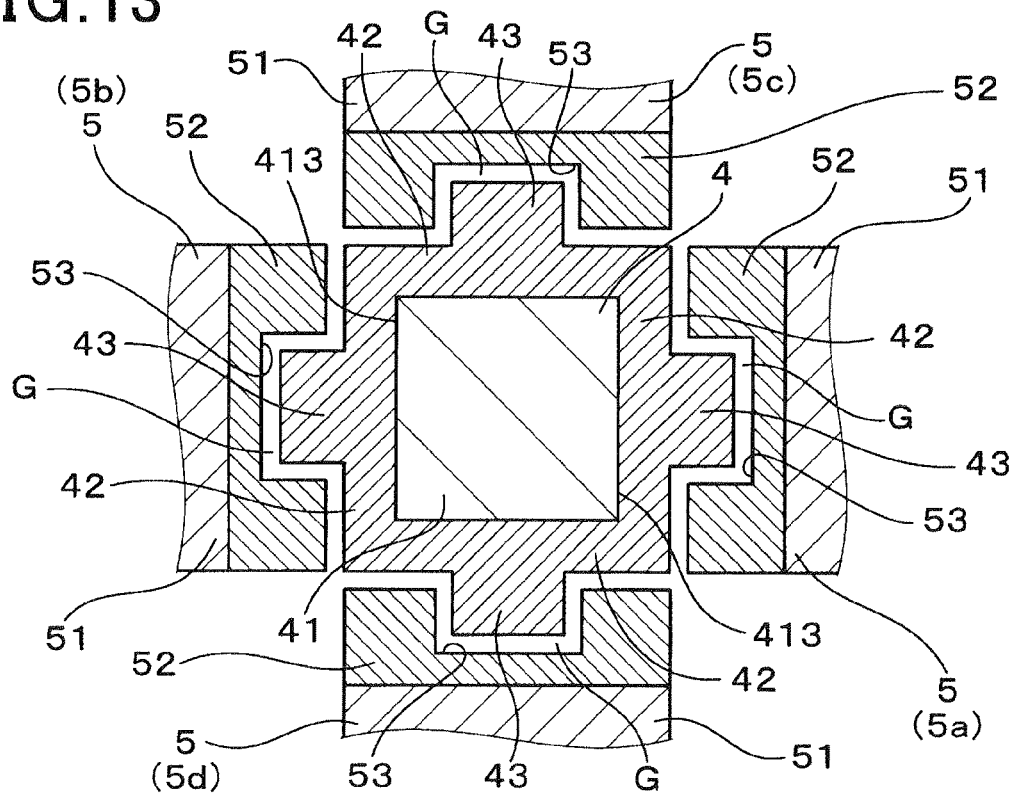
FIG. 13 is a sectional view showing structures of a center electrode and an earth electrode according to the third embodiment.

In the example shown in FIG. 13, four earth electrodes 5 (5*a* to 5*d*) are provided with respect to the center electrode 4.

As shown in FIG. 13, four earth electrodes 5*a* to 5*d* are connected to the end surface 201 (FIG. 10) of the housing 2 (FIG. 10). The opposing portions 51 of the four earth electrodes 5*a* to 5*d* are provided so as to extend toward the end portion 41 of the center electrode 4 from four directions and in the direction orthogonal to the axis direction of the spark plug 1 (FIG. 10).

As shown in FIG. 13, the square pole-shaped end portion 41 of the center electrode 4 is provided with four side surfaces 413. The four side surfaces 413 are provided with four end projecting portions 42 projecting toward the opposing portions 51 of the earth electrodes 5*a* to 5*d*. The four end projecting portions 42 are integrally formed.

In addition, the opposing portions 51 of the earth electrodes 5*a* to 5*c* are provided with four opposing projecting portions 52 which project toward the end portion 41 of the center electrode 4 and are opposed to the end projecting portions 42 of the end portion 41.

Other basic configurations and advantages of the examples described above are the same as those of the first embodiment.

Fourth Embodiment

Figure 14:
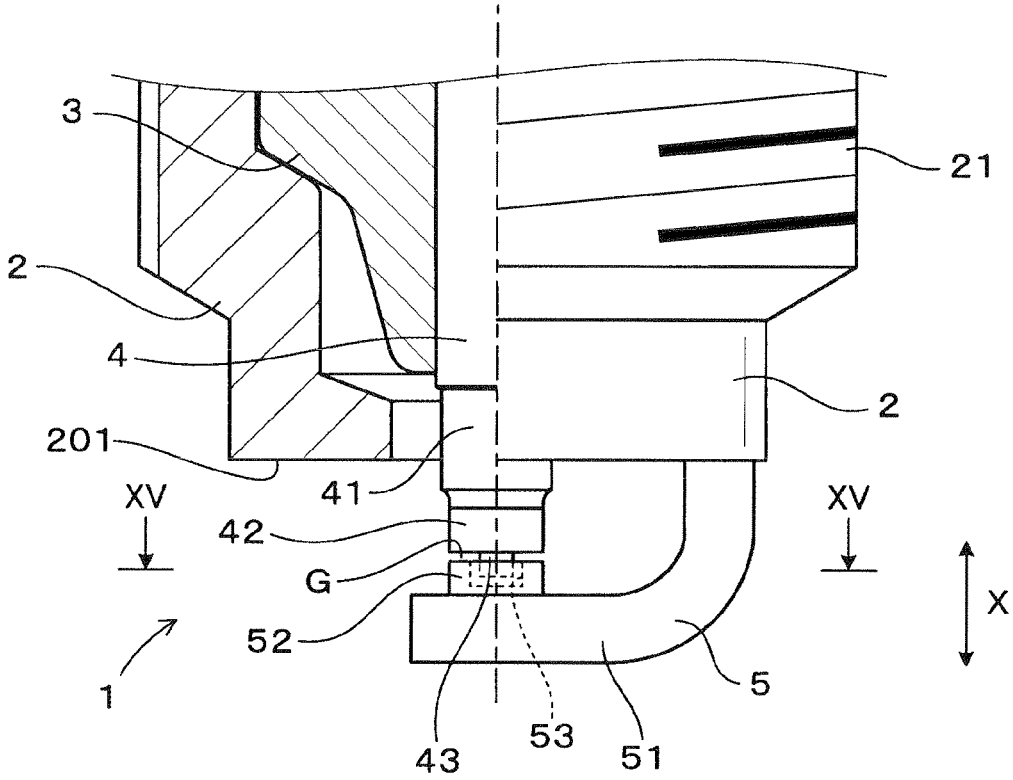
FIG. 14 is a partial sectional view showing a structure of a spark plug according to a fourth embodiment.
Figure 15:
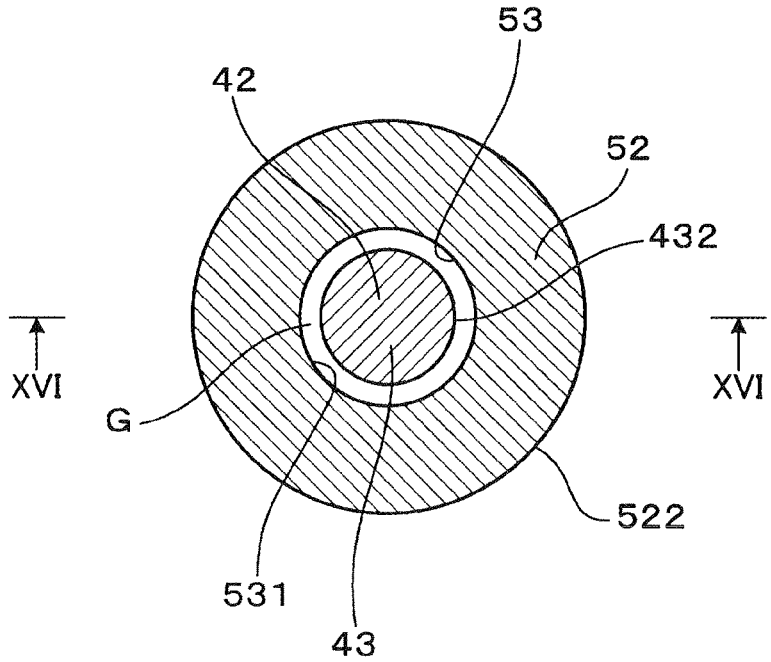
FIG. 15 is a sectional view taken in the direction of arrows XV of FIG. 14.
Figure 16A:
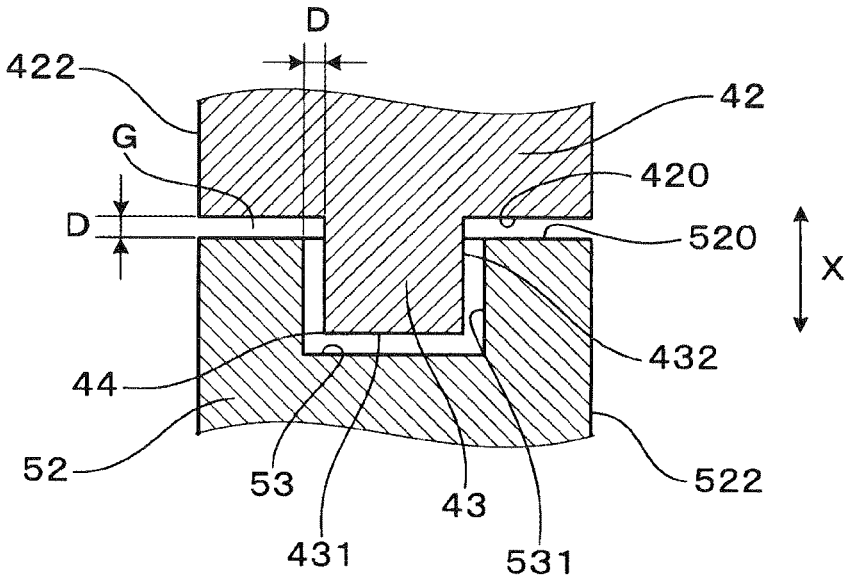
FIG. 16A is a sectional view taken in the direction of arrows XVI of FIG. 15 and showing shapes of an end projecting portion of a center electrode and an opposing projecting portion of an earth electrode.
Figure 16B:
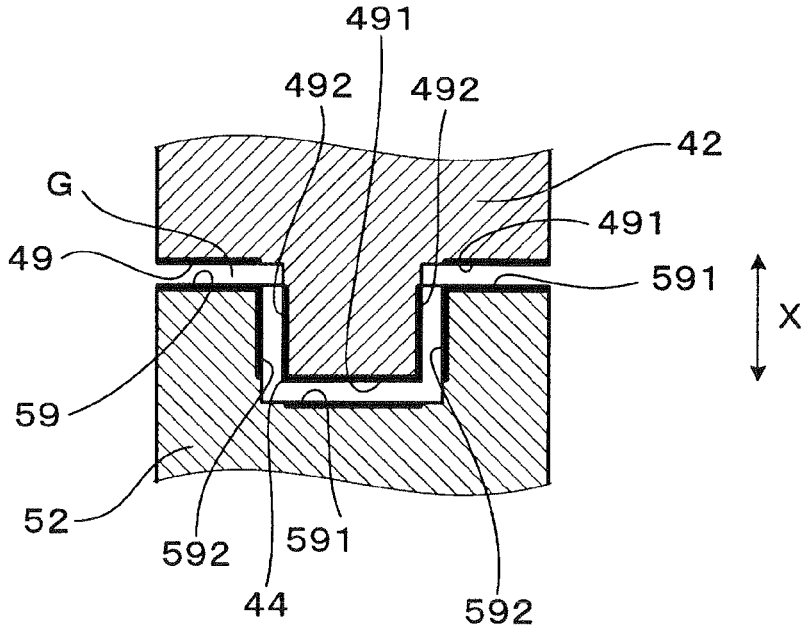
FIG. 16B is a sectional view taken in the direction of arrows XVI of FIG. 15 and showing an opposing surface.

In the present embodiment, as shown in FIGS. 14 to 16, the shapes of the end projecting portion 42 of the center electrode 4 and the opposing projecting portion 52 of the earth electrode 5 are changed.

As shown in FIGS. 14 to 16, the end projecting portion 42 of the center electrode 4 is provided with a projection portion 43 which has a substantially cylindrical shape and whose central portion projects from the reference surface 420 thereof toward the end side. In the present embodiment, the outside diameter of the projection portion 43 can be set within a range of, for example, 0.8 to 1 mm.

In addition, the opposing projecting portion 52 of the earth electrode 5 is provided with the concave portion 53 which has a substantially cylindrical shape recessed from a reference surface 520 of the opposing projecting portion 52 toward the end side.

In addition, the whole outer periphery of at least part of the projection portion 43 of the end projecting portion 42 of the center electrode 4, which includes the corner portions 44, is covered with the opposing projecting portion 52 of the earth electrode 5.

Other basic configurations are the same as those of the first embodiment.

In this case, the whole outer periphery of at least part of the projection portion 43 of one (end projecting portion 42) of the end projecting portion 42 and the opposing projecting portion 52, which includes the corner portions 44, is covered with the other (opposing projecting portion 52) of the end projecting portion 42 and the opposing projecting portion 52. Hence, a spark discharge is generated more easily from the corner portions 44 of the convex projection portion 43 of the end projecting portion 42 toward the opposing projecting portion 52, which can further decrease the required voltage which is required for the spark discharge. Hence, wear of the electrode due to the spark discharge can be further restrained, which can further extend the lifetime of the spark plug.

Other basic advantages are the same as those of the first embodiment.

Fifth Embodiment

In the present embodiment, lifetime of the spark plug (plug lifetime) is evaluated.

In the present embodiment, as shown in a table 1, spark plugs (specimens S11 to S14) are prepared in which the opposing area A is 1.25 times larger than the opposing area B (A/B=1.25). In addition, for comparison purposes, spark plugs (specimens S21 to S24) are prepared in which the opposing area A is the same as the opposing area B (A/B=1). The opposing areas A, B, and the opposing area ratio of A to B are shown in the table 1.

Then, regarding the spark plug, the change of the plug lifetime is examined while changing the opposing area A and the opposing area B.

TABLE 1

| Specimen No. | Opposing area A ($mm^2$) | Opposing area B ($mm^2$) | Opposing area ratio A/B |
|---|---|---|---|
| S11 | 8.3 | 6.6 | 1.25 |
| S12 | 20 | 16 | |
| S13 | 33.8 | 27 | |
| S14 | 45 | 36 | |
| S21 | 6.6 | 6.6 | 1 |
| S22 | 16 | 16 | |
| S23 | 27 | 27 | |
| S24 | 36 | 36 | |

Next, with reference to the table 1, structures of the prepared spark plugs (specimens S11 to S14, S21 to S24) are explained.

The specimens S11 to S14 are spark plugs, in which one earth electrode is provided with respect to one center electrode, and the shapes of the end projecting portion of the center electrode and the opposing projecting portion of the earth electrode are the same as the example shown in FIGS. 9A and 9B. Note that the angle of inclination of the end surface of the end projecting portion of the center electrode and the end surface of the opposing projecting portion of the earth electrode are adjusted so that the opposing area A is 1.25 times larger than the opposing area B (A/B=1.25).

The specimens S21 to S24 are spark plugs, in which one earth electrode is provided with respect to one center electrode, and the shapes and structures of the end projecting portion of the center electrode and the opposing projecting portion of the earth electrode are the same as the example shown in FIG. 19.

Next, a method for evaluating the plug lifetime is described.

First, a spark plug is attached to an engine bench (engine test bed). Next, a voltage is applied between the center electrode and the earth electrode of the spark plug to repeatedly generate a spark discharge within the spark discharge gap. Conditions for spark discharge are set as follows: pressure is 0.6 MPa, discharge cycle is 60 Hz, and ignition energy is 110 mJ. Then, elapsed time is measured until the time when a spark discharge is started in a portion other than the spark discharge gap, or the time when discharge voltage exceeds a constant value, the times being assumed as the plug lifetime.

Figure 17:
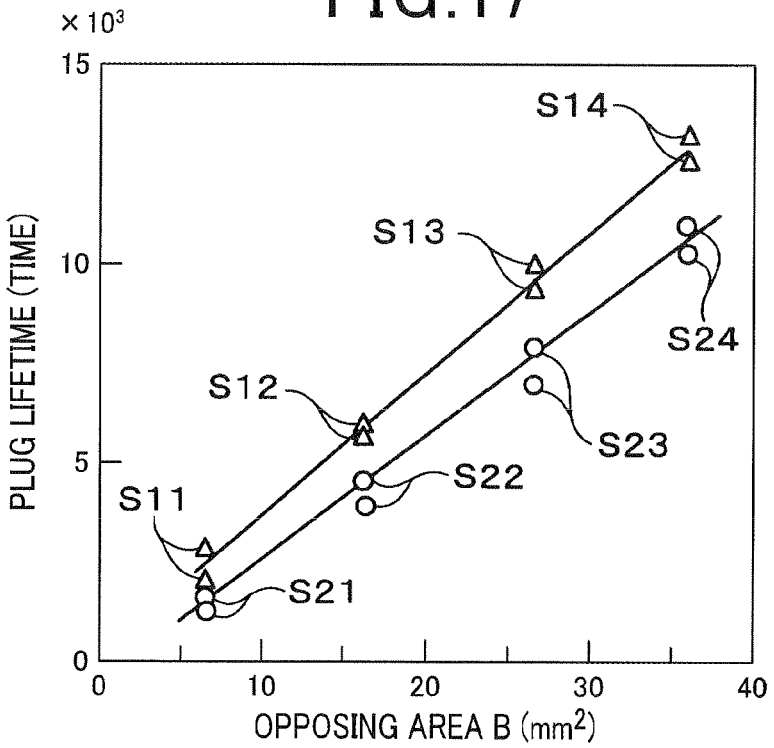
FIG. 17 is a graph showing a relationship between opposing area A and lifetime of a plug according to a fifth embodiment.

FIG. 17 shows an evaluation result of plug lifetime. In FIG. 17, the horizontal axis indicates opposing area B ($mm^2$), and the vertical axis indicates plug lifetime (time). In FIG. 17, two points are plotted for each specimen.

According to FIG. 17, regarding the specimens S11 to S14, it can be understood that if the opposing areas B thereof are the same, plug lifetimes thereof are longer than that of the specimens S21 to S24 because the opposing area A and the opposing area ratio A/B thereof are larger than those of the specimens S21 to S24. In addition, as a whole, it can be understood that as the opposing area B becomes larger, that is, as the opposing area A becomes larger, the plug lifetime becomes longer.

As a result, it is confirmed that, since the end projecting portion of the center electrode and the opposing projecting portion of the earth electrode are provided with non-projection direction opposing surfaces, and the opposing area A is larger than the opposing area B, the opposing area between the center electrode and the earth electrode can be increased with a simple structure, which can extend the lifetime of the spark plug. In addition, it is confirmed that as the opposing area A becomes larger, the plug lifetime becomes longer.

Sixth Embodiment

In the present embodiment, the lifetime of the spark plug (plug lifetime) is evaluated.

In the present embodiment, as shown in a table 2, spark plugs (specimens S31 to S34) whose opposing area B is 6.6 $mm^2$ and spark plugs (specimens S41 to S44) whose opposing area B is 27 $mm^2$ are prepared. The opposing areas A, B and the opposing area ratio A/B of the specimens are shown in the table 2.

Then, regarding each of the spark plugs, change of the plug lifetime is examined while changing the opposing area ratio A/B by controlling the opposing area A.

Note that the method for evaluating the plug lifetime is the same as that of the fifth embodiment.

TABLE 2

| Specimen No. | Opposing area A ($mm^2$) | Opposing area B ($mm^2$) | Opposing area ratio A/B |
|---|---|---|---|
| S31 | 6.6 | 6.6 | 1 |
| S32 | 8.3 | | 1.25 |
| S33 | 9.9 | | 1.5 |
| S34 | 11.6 | | 1.75 |
| S41 | 27 | 27 | 1 |
| S42 | 33.8 | | 1.25 |
| S43 | 40.5 | | 1.5 |
| S44 | 47.3 | | 1.75 |

Next, with reference to the table 2, structures of the prepared spark plugs (specimens S31 to S34, S41 to S44) are explained.

The specimens S31 to S34 are spark plugs, in which one earth electrode is provided with respect to one center electrode, and the shapes and structures of the end projecting portion of the center electrode and the opposing projecting portion of the earth electrode are the same as the example shown in FIGS. 3A and 3B.

The specimens S41 to S44 are spark plugs, in which three earth electrodes are provided with respect to one center electrode, and the shapes and structures of the end projecting portion of the center electrode and the opposing projecting portion of the earth electrode are the same as the example shown in FIG. 12.

Figure 18:
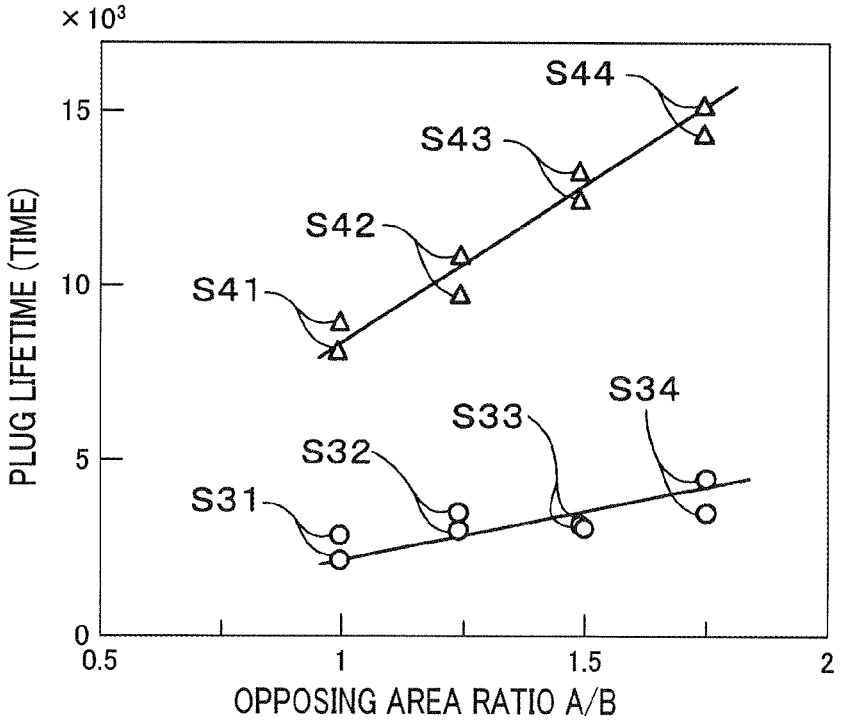
FIG. 18 is a graph showing a relationship between opposing area ratio A/B and lifetime of a plug according to a sixth embodiment.

FIG. 18 shows an evaluation result of plug lifetime. In FIG. 18, the horizontal axis indicates the opposing area ratio A/B, and the vertical axis indicates plug lifetime (time). In FIG. 18, two points are plotted for each specimen.

According to FIG. 18, it can be understood that when comparing the specimens having the same opposing area A with each other, plug lifetime of the specimens S32 to S34 whose opposing area ratio A/B is more than 1 is longer than that of the specimen S31 whose opposing area ratio A/B is 1. It can be understood that plug lifetimes of the specimens S42 to S44 whose opposing area ratio A/B is more than 1 are longer than that of the specimen S41 whose opposing area ratio A/B is 1. In addition, as a whole, it can be understood that as the opposing area ratio A/B becomes larger, the plug lifetime becomes longer.

In addition, when comparing FIG. 17 of the fifth embodiment with FIG. 18 of the present embodiment, it can be understood that plug lifetime of the specimen S32, whose opposing area A is 8.3 $mm^2$, opposing area B is 6.6 $mm^2$, and opposing area ratio A/B is 1.25, is longer than that of the specimen S11, whose opposing area A, opposing area B, and opposing area ratio A/B are the same as those of the specimen S32. In addition, it can be understood that plug lifetime of the specimen S42, whose opposing area A is 33.8 $mm^2$, opposing area B is 27 $mm^2$, and opposing area ratio A/B is 1.25, is longer than that of the specimen S13, whose opposing area A, opposing area B, and opposing area ratio A/B are the same as those of the specimen S42.

That is, according to FIGS. 17 and 18, it can be understood that the plug lifetimes of the specimens S32, S42, in which the end projecting portion of the center electrode is provided with the projection portion which is provided with the corner portions, is further longer than the plug lifetimes of the specimens S11, S13, in which the end projecting portion of the center electrode is not provided with the projection portion and the corner portions.

As a result, it can be understood that, by making the opposing area ratio A/B of the spark plug higher, the advantage to extend the lifetime of the spark plug can be effectively utilized by increasing the opposing area of the center electrode and the earth electrode with a simple structure.

In addition, it can be understood that, by providing the projection portion to the end projecting portion of the center electrode, and providing the corner portions to the projection portion, the lifetime of the spark plug can be further extended.

It will be appreciated that the present invention is not limited to the configurations described above, but any and all modifications, variations or equivalents, which may occur to those who are skilled in the art, should be considered to fall within the scope of the present invention.

Hereinafter, aspects of the above-described embodiments will be summarized.

As an aspect of the embodiment, a spark plug (1) for an internal combustion engine is provided. The spark plug (1) includes: a tubular housing (2); a tubular insulator (3) which is held inside the housing (2); a center electrode (4) which is held inside the insulator (3) so that an end portion (41) thereof projects; and an earth electrode (5) which has an opposing portion (51) opposed to the end portion (41) of the center electrode (4), a spark discharge gap (G) being formed between the opposing portion (51) and the end portion (41). The end portion (41) is provided with an end projecting portion (42) projecting toward the opposing portion (51). The opposing portion (51) is provided with an opposing projecting portion (52) which projects toward the end portion (41) and is opposed to the end projecting portion (42). The end projecting portion (42) and the opposing projecting portion (52) are provided with non-projection direction opposing surfaces (492, 592) which are parallel to each other and are opposed to each other with a minimum distance (D) being interposed therebetween and in a direction other than a projection direction (X) thereof. When defining an opposing area of a portion which includes the non-projection direction opposing surfaces (492, 592) and where the end projecting portion (42) and the opposing projecting portion (52) are opposed to each other with the minimum distance (D) being interposed therebetween, as a first opposing area, and defining an opposing area obtained when a plane (490) of the end projecting portion (42) and a plane (590) of the opposing projecting portion (52), which are orthogonal to the projection direction (X), are opposed to each other in the projection direction (X), as a second opposing area, the first opposing area is larger than the second opposing area.

In the above spark plug, the end projecting portion of the center electrode and the opposing projecting portion of the earth electrode are provided with non-projection direction opposing surfaces which are parallel to each other and are opposed to each other with the minimum distance being interposed therebetween and in the direction other than the projection direction thereof. The first opposing area of a portion which includes the non-projection direction opposing surfaces and where the end projecting portion and the opposing projecting portion are opposed to each other with the minimum distance being interposed therebetween is larger than the second opposing area obtained when a plane of the end projecting portion and a plane of the opposing projecting portion, which are orthogonal to the projection direction, are opposed to each other in the projection direction Hence, by a simple structure, in which the non-projection direction opposing surfaces are provided on the end projecting portion of the center electrode and the opposing projecting portion of the earth electrode, an opposing area (discharge area) between the center electrode and the earth electrode can be easily increased. As a result, the extension of the spark discharge gap due to wear of the end projecting portion and the opposing projecting portion caused by the spark discharge can be restricted, which can extend the lifetime of the spark plug.

In addition, an opposing area between the center electrode and the earth electrodes can be increased by a simple structure. Hence, shapes of the end projecting portion of the center electrode and the opposing projecting portion of the earth electrode can be prevented from being complicated. In addition, the size (outside diameter or the like) of the end projecting portion of the center electrode and the opposing projecting portion of the earth electrode can be prevented from increasing.

As described above, a spark plug for an internal combustion engine can be provided which can increase an opposing area between a center electrode and an earth electrode by a simple structure, thereby extending lifetime of the spark plug.

In the spark plug, the side which is inserted into a combustion chamber of the internal combustion engine is referred to as an end side (end side in the axial direction).

In addition, as described above, the spark plug includes the earth electrode. The spark discharge gap is provided between the earth electrode and the end portion of the center electrode. One or more earth electrodes may be provided with respect to the center electrode.

In addition, the first opposing area is an area of a portion which includes the non-projection direction opposing surfaces and where the end projecting portion and the opposing projecting portion are opposed to each other with the minimum distance being interposed therebetween. That is, the first opposing area is an area of a portion of the end projecting portion which includes the non-projection direction opposing surface and where the end projecting portion is opposed to the opposing projecting portion with the minimum distance being interposed therebetween, and an area of a portion of the opposing projecting portion which includes the non-projection direction opposing surface and where the opposing projecting portion is opposed to the end projecting portion with the minimum distance being interposed therebetween. The two areas are the same.

In addition, the second opposing area is an opposing area obtained when a plane of the end projecting portion and a plane of the opposing projecting portion, which are orthogonal to the projection direction, are opposed to each other in the projection direction without changing the outer shapes of the end projecting portion and the opposing projecting portion.

In addition, one of the end projecting portion (42) and the opposing projecting portion (52) is provided with a projection portion (43) projecting toward the other of the end projecting portion (42) and the opposing projecting portion (52). The projection portion (43) is provided with corner portions (44) opposed to the other with the minimum distance (D) being interposed therebetween.

In this case, spark discharge easily occurs from the corner portions of the projection portion provided on one of the end projecting portion and the opposing projecting portion toward the other of the end projecting portion and the opposing projecting portion, which can decrease the required voltage which is required for the spark discharge. Hence, wear of the electrode due to the spark discharge can be restrained, which can further extend the lifetime of the spark plug.

In addition, the projection portion is provided on the negative electrode side, which is one of the end projecting portion of the center electrode and the opposing projecting portion of the earth electrode. For example, when the earth electrode is used as the positive electrode side, and the center electrode is used as the negative electrode side, sparks are emitted from the center electrode to the earth electrode. In this case, the projection portion is provided on the end projecting portion of the center electrode. Hence, the advantage described above can be effectively utilized.

In addition, the whole outer periphery of at least part of the projection portion (43) of one of the end projecting portion (42) and the opposing projecting portion (52), which includes the corner portions (44), is covered with the other of the end projecting portion (42) and the opposing projecting portion (52).

In this case, a spark discharge is generated more easily from the corner portions of the projection portion of one of the end projecting portion and the opposing projecting portion toward the other of the end projecting portion and the opposing projecting portion, which can further decrease the required voltage which is required for the spark discharge. Hence, wear of the electrode due to the spark discharge can be further restrained, which can further extend the lifetime of the spark plug.

In addition, the first opposing area is preferably 1.25 times or more larger than the second opposing area.

In this case, the above advantage to extend the lifetime of the spark plug can be effectively utilized by increasing the opposing area between the center electrode and the earth electrode with a simple structure.

In addition, the first opposing area is preferably 1.75 times or less larger than the second opposing area.

For example, if the first opposing area is more than 1.75 times larger than the second opposing area, shapes of the end projecting portion of the center electrode and the opposing projecting portion of the earth electrode can be complicated, the size (outside diameter or the like) of the end projecting portion and the opposing projecting portion can increase, and manufacturing the end projecting portion and the opposing projecting portion can be difficult.

What is claimed is:

1. A spark plug for an internal combustion engine, comprising:

a tubular housing;

a tubular insulator which is held inside the housing;

a center electrode which is held inside the insulator so that an end portion thereof projects; and an earth electrode which has an opposing portion opposed to the end portion of the center electrode, a spark discharge gap being formed between the opposing portion and the end portion, wherein the end portion is provided with an end projecting portion projecting toward the opposing portion, the opposing portion is provided with an opposing projecting portion which projects toward the end portion and is opposed to the end projecting portion, the end projecting portion and the opposing projecting portion are provided with non-projection direction opposing surfaces which are parallel to each other and are opposed to each other with a minimum distance being interposed therebetween and in a direction other than a projection direction thereof, when defining an opposing area of a portion which includes the non-projection direction opposing surfaces and where the end projecting portion and the opposing projecting portion are opposed to each other with the minimum distance being interposed therebetween, as a first opposing area, and defining an opposing area obtained when a plane of the end projecting portion and a plane of the opposing projecting portion, which are orthogonal to the projection direction, are opposed to each other in the projection direction, as a second opposing area, the first opposing area is larger than the second opposing area, and one of the end projecting portion of the center electrode and the opposing projecting portion of the earth electrode is provided with a projection portion, the whole outer periphery of at least part of which is covered with the other of the end projecting portion and the opposing projecting portion and which projects toward the other of the end projecting portion and the opposing projecting portion.

2. The spark plug, according to claim 1, wherein the projection portion is provided with corner portions opposed to the other of the end projecting portion and the opposing projecting portion with the minimum distance being interposed therebetween.

3. The spark plug, according to claim 2, wherein the whole outer periphery of at least part of the projection portion of one of the end projecting portion and the opposing projecting portion, which includes the corner portions, is covered with the other of the end projecting portion and the opposing projecting portion.

4. The spark plug, according to claim 1, wherein the first opposing area is 1.25 times or more larger than the second opposing area.

* * * * *